US005992412A

United States Patent [19]

Paulger

[11] Patent Number: 5,992,412

[45] Date of Patent: Nov. 30, 1999

[54] FILTERED SMOKE SCREEN

[76] Inventor: Russell A. Paulger, 2 Paisley Rd., Carshalton, Surrey, United Kingdom, SM5 1SR

[21] Appl. No.: 09/019,024

[22] Filed: Feb. 5, 1998

[51] Int. Cl.[6] ..... F24C 15/20; F24F 9/00; B01D 50/00

[52] U.S. Cl. ..... 126/299 R; 454/188; 454/104; 454/248; 454/190; 55/315

[58] Field of Search ..... 126/299 R; 454/188, 454/104, 105, 248, 249, 190; 55/315

[56] References Cited

U.S. PATENT DOCUMENTS

| | | | |
|---|---|---|---|
| 2,157,307 | 5/1939 | Savage | 454/266 |
| 2,675,094 | 4/1954 | Young | 55/480 |
| 2,886,124 | 5/1959 | Scharmer | 126/299 R |
| 3,229,609 | 1/1966 | Larson et al. | 454/190 |
| 3,572,234 | 3/1971 | Schoenthaler | 454/188 |
| 3,861,894 | 1/1975 | Marsh | 55/315 |
| 4,094,232 | 6/1978 | Howorth | 454/190 |
| 4,838,910 | 6/1989 | Stollenwerk et al. | 55/500 |
| 5,141,706 | 8/1992 | Clark | 55/315 |

*Primary Examiner*—Ira S. Lazarus
*Assistant Examiner*—David Lee

[57] ABSTRACT

A smoke diverter system is provided including an elongated ceiling housing, an elongated outlet slot formed along a length of a bottom face of the ceiling housing. An elongated inlet slot is formed along a length of one of a pair of side faces of the ceiling housing adjacent to the top face thereof. At least one elongated intake filter is mounted between the inlet slot and the outlet slot of the housing. A vacuum fan is secured within the interior space of the ceiling housing for suctioning air from the inlet slot and excreting the same from the outlet slot.

7 Claims, 3 Drawing Sheets

FILTERED SMOKE SCREEN

BACKGROUND OF THE INVENTION

1. Field of the Invention

The present invention relates to air screens and more particularly pertains to a new filtered smoke screen for affording a filtered air screen to preclude the passage of smoke between two areas.

2. Description of the Prior Art

The use of air screens is known in the prior art. More specifically, air screens heretofore devised and utilized are known to consist basically of familiar, expected and obvious structural configurations, notwithstanding the myriad of designs encompassed by the crowded prior art which have been developed for the fulfillment of countless objectives and requirements.

Known prior art air screens include U.S. Pat. No. 4,315,456; U.S. Pat. No. 4,450,755; U.S. Pat. Des. 361,414; U.S. Pat. No. 4,123,967; U.S. Pat. No. 4,788,905; and U.S. Pat. No. 5,042,456.

In these respects, the filtered smoke screen according to the present invention substantially departs from the conventional concepts and designs of the prior art, and in so doing provides an apparatus primarily developed for the purpose of affording a filtered air screen to preclude the passage of smoke between two areas.

SUMMARY OF THE INVENTION

In view of the foregoing disadvantages inherent in the known types of air screens now present in the prior art, the present invention provides a new filtered smoke screen construction wherein the same can be utilized for affording a filtered air screen to preclude the passage of smoke between two areas.

The general purpose of the present invention, which will be described subsequently in greater detail is to provide a new filtered smoke screen apparatus and method which has many of the advantages of the air screens mentioned heretofore and many novel features that result in a new filtered smoke screen which is not anticipated, rendered obvious, suggested, or even implied by any of the prior art air screens, either alone or on any combination thereof.

To attain this, the present invention generally comprises an elongated ceiling housing having a horizontally oriented planar top face. A pair of vertically oriented side faces are integrally coupled to opposed edges of the top face and depend downwardly therefrom. The elongated ceiling housing further has a bottom face thereby defining an interior space. As shown in FIGS. 2 & 3, the bottom face has a pair of beveled side extents coupled between the side faces and a planar horizontally oriented central extent. The elongated ceiling housing is mounted to a ceiling of a room between a smoking and a nonsmoking section. Formed along a length of the central extent of the bottom face of the ceiling housing is an elongated outlet slot. Associated therewith is an elongated inlet slot formed along a length of one of the side faces of the ceiling housing adjacent to the top face thereof. An elongated intake filter has long edges mounted between a midpoint of the top face and a midpoint of one of the side faces of the ceiling housing with the inlet slot formed therein. The intake filter serves for filtering air received via the inlet slot. An elongated outlet filter has long edges mounted between the side faces of the ceiling housing adjacent to the bottom face. The outlet filter functions for filtering air excreted via the outlet slot. Further provided is a vacuum fan mounted within the interior space of the ceiling housing. An axis of rotation of the fan is situated in perpendicular relationship with the inlet filter. During use, the fan is connected to a power source for suctioning air from the inlet slot and excreting the same from the outlet slot. FIG. 4 shows an elongated floor housing having a horizontally oriented planar bottom face. A pair of vertically oriented side faces are integrally coupled to opposed edges of the bottom face and extend upwardly therefrom. The floor housing further includes a top face to define an interior space. The top face has a pair of beveled side extents coupled between the side faces and a planar horizontally oriented central extent. For positioning of the floor housing between the smoking and the nonsmoking section below the ceiling housing, the elongated floor housing has a plurality of rollers mounted to the bottom face thereof. An elongated outlet slot is formed along a length of the central extend of the top face of the floor housing. Formed along a length of the bottom face of the floor housing is an elongated inlet slot. For suctioning air from the inlet slot and excreting the same from the outlet slot of the floor housing, a vacuum fan is mounted within the interior space of the floor housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new filtered smoke screen apparatus and method which has many of the advantages of the air screens mentioned heretofore and many novel features that result in a new filtered smoke screen which is not anticipated, rendered obvious, suggested, or even implied by any of the prior art air screens, either alone, or in any combination thereof.

It is another object of the present invention to provide a new filtered smoke screen which may be easily and efficiently manufactured and marketed.

It is a further object of the present invention to provide a new filtered smoke screen which is of a durable and reliable construction.

An even further object of the present invention is to provide a new filtered smoke screen which is susceptible of a low cost of manufacture with regard to both materials and labour, and which accordingly is then susceptible of low prices of sale to the consuming public, thereby making such filtered smoke screen economically available to the buying public.

Still yet another object of the present invention is to provide a new filtered smoke screen which provides in the apparatuses and methods of the prior art some of the advantages thereof, while simultaneously overcoming some of the disadvantages normally associated therewith.

Still another object of the present invention is to provide a new filtered smoke screen for affording a filtered air screen to preclude the passage of smoke between two areas.

Even still another object of the present invention is to provide a new filtered smoke screen that includes an elongated ceiling housing, an elongated outlet slot formed along a length of a bottom face of the ceiling housing. An elongated inlet slot is formed along a length of one of a pair of side faces of the ceiling housing adjacent to the top face thereof. At least one elongated intake filter is mounted between in the inlet slot and the outlet slot of the housing. A vacuum fan is secured within the interior space of the ceiling housing for suctioning air from the inlet slot and excreting the same from the outlet slot.

These together with other objects of the invention, along with the various features of novelty which characterize the invention, are pointed out with particularity in the claims annexed to and forming a part of this disclosure. For a better understanding of the invention, its operating advantages and the specific objects attained by it uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
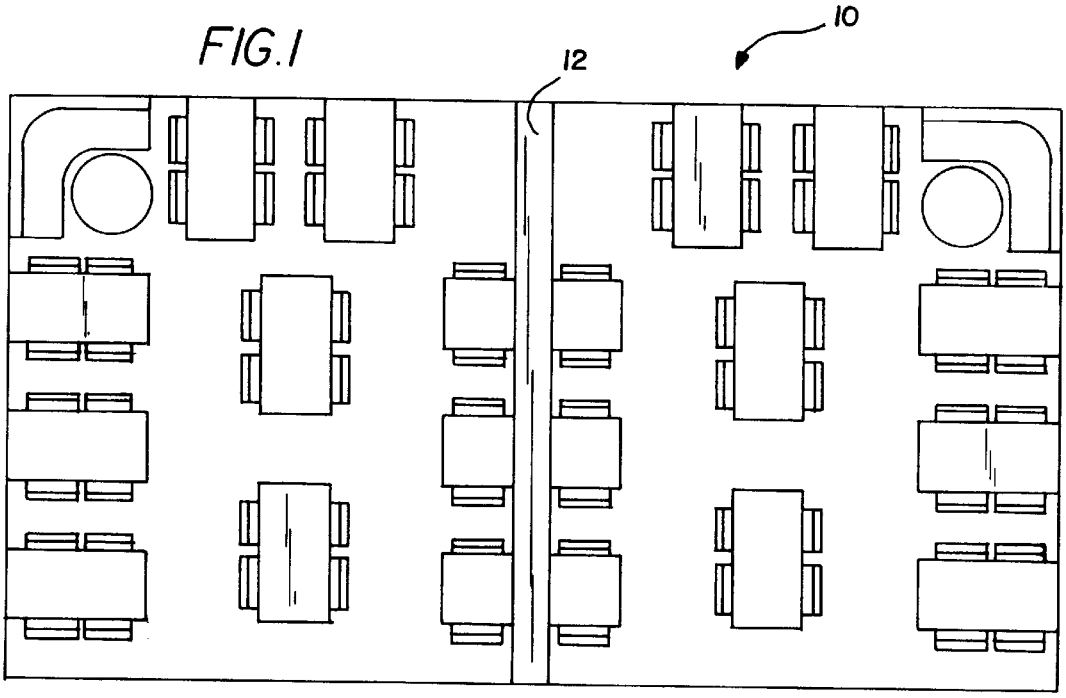
FIG. 1 is a plan view of a new filtered smoke screen according to the present invention.

With reference now to the drawings and in particular to FIGS. 1 through 4 thereof, a new filtered smoke screen embodying the principles and concepts of the present invention and generally designated by the reference numeral 10 will be described.

Figure 2:
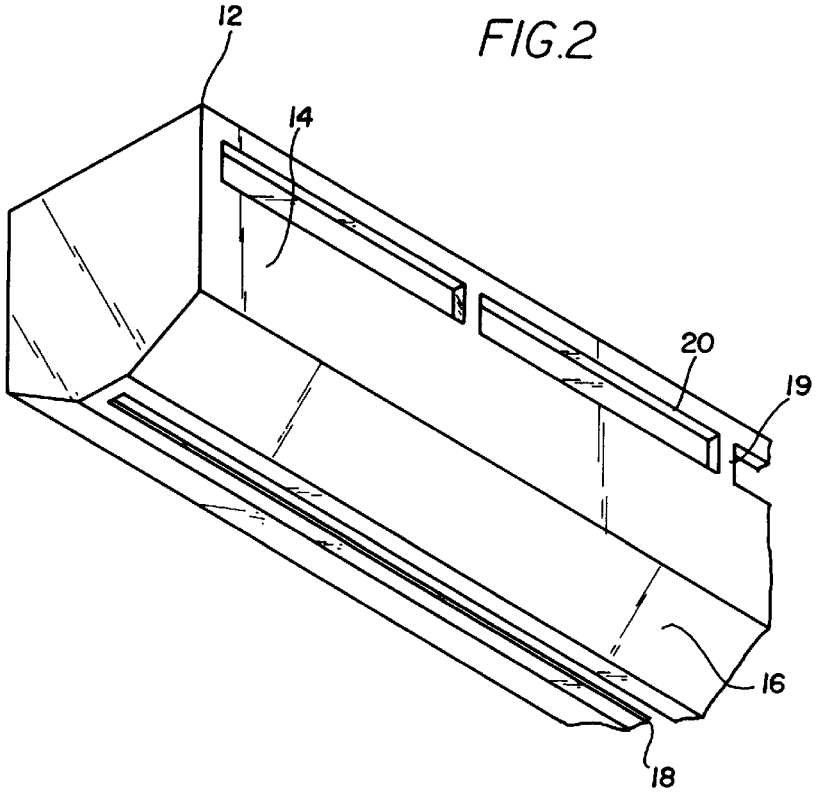
FIG. 2 is a perspective view of the present invention.
Figure 3:
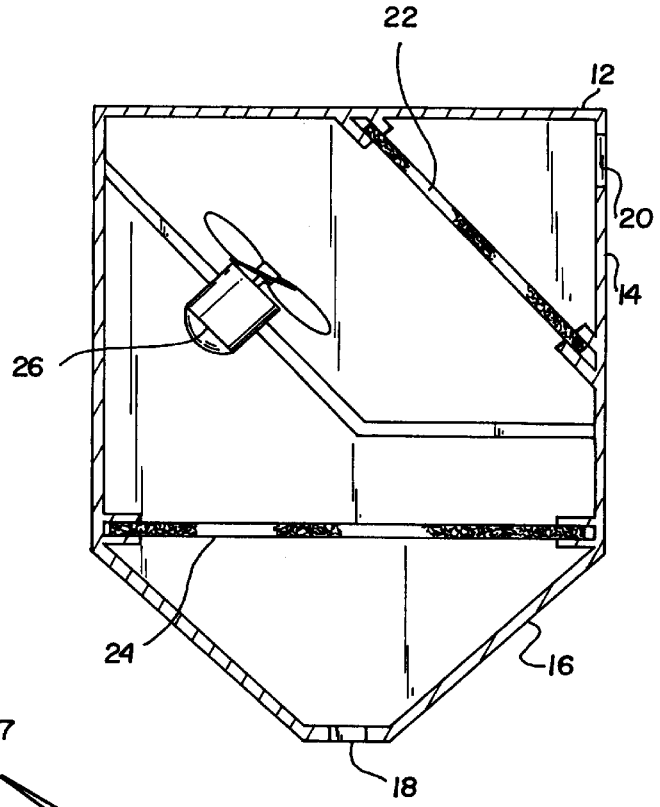
FIG. 3 is a vertical cross-sectional view of the present invention.

The present invention, designated is numeral 10, includes and elongated ceiling housing 12 having a horizontally oriented planar top face. A pair of vertically oriented side faces 14 are integrally coupled to opposed edges of the top face and depend downwardly therefrom. The elongated ceiling housing further has a bottom face which defines an interior space. As shown in FIGS. 2 & 3, the bottom face has a pair of beveled side extents 16 coupled between the side faces and a planar horizontally oriented central extent. The beveled side extents each preferably form a 45 degree angle with the horizontal. In operation, the elongated ceiling housing is mounted to a ceiling of a room between a smoking and a nonsmoking section.

Formed along a length of the central extent of the bottom face of the ceiling housing is an elongated outlet slot 18. As shown is FIG. 2, the slots may be segmented with intermediate stanchions 19 for strengthening purposes. Associated therewith is an elongated inlet slot 20 formed along a length of one of the side faces of the ceiling housing adjacent to the top face thereof.

An elongated intake filter 22 has long edges mounted between a midpoint of the top face and a midpoint of one of the side faces of the ceiling housing with the inlet slot formed therein. The intake filter serves for filtering air received via the inlet slot. An elongated outlet filter 24 has long edges mounted between the side faces of the ceiling housing adjacent to the bottom face. The outlet filter functions for filtering air excreted via the outlet slot. Both of the filters are preferably mounted within the interior space of the ceiling housing by way of a groove adapted to receive the periphery of the filter.

Further provided is a vacuum fan 26 mounted within the interior space of the ceiling housing. To accomplish this, a thin bracket is mounted between the side faces of the ceiling housing. An axis of rotation of the fan is situated in perpendicular relationship with the inlet filter. During use, the fan is connected to a power source for suctioning air from the inlet slot and excreting the same from the outlet slot, it should be noted that depending on the length of the housing, multiple fans may be required.

Figure 4:
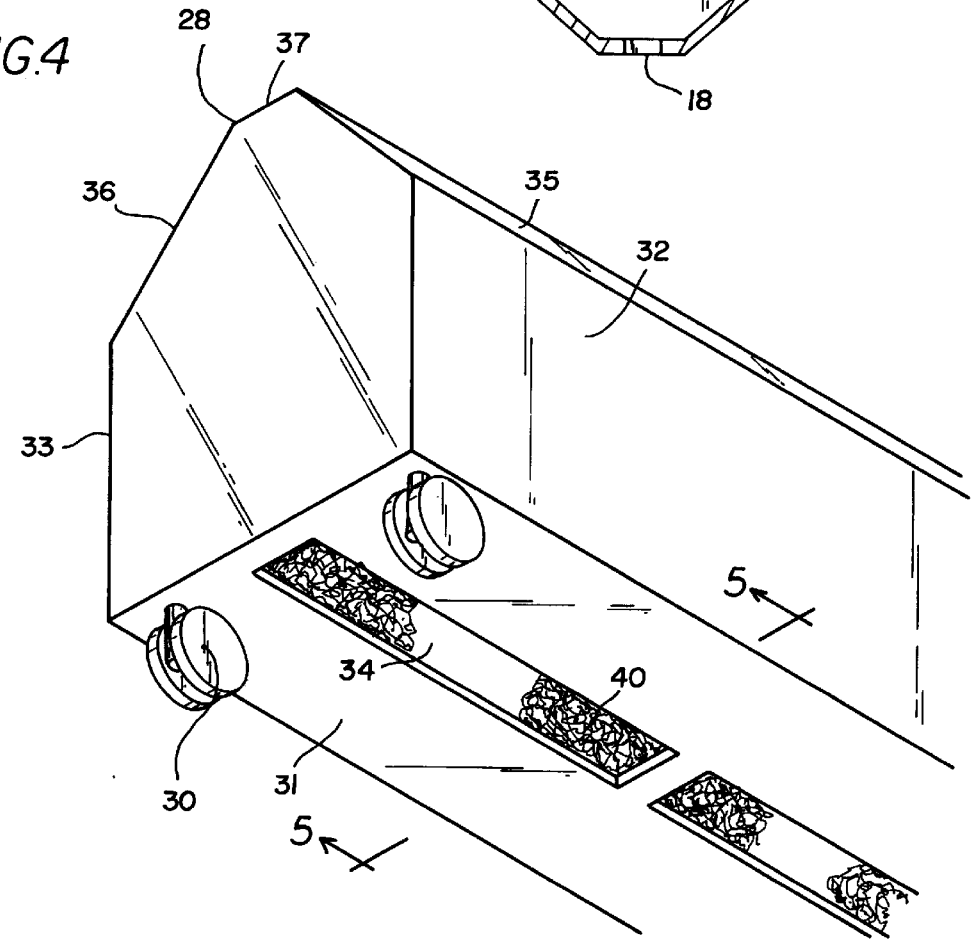
FIG. 4 is a perspective view of the alternate embodiment of the present invention.
Figure 5:
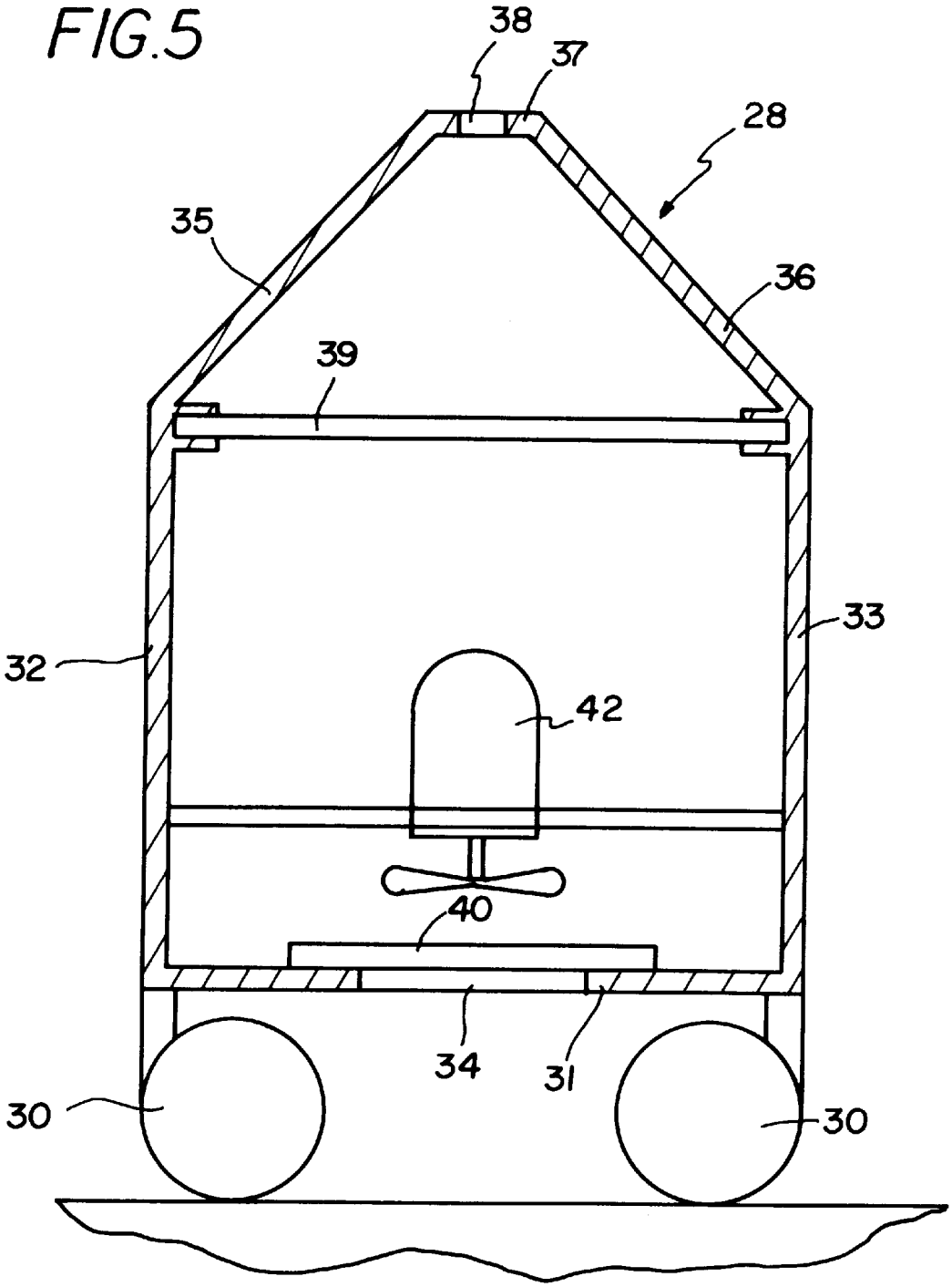
FIG. 5 is a schematic sectional view of an optional second housing of the invention take from the perspective of line 5—5 in FIG. 4.

FIG. 4 shows an elongated floor housing 28 having a horizontally oriented planar bottom face. A pair of vertically oriented side faces 32, 33 are integrally coupled to opposed edges of the bottom face and extended upwardly therefrom. The floor housing further includes a top face to define an interior space. The top face has a pair of beveled side extents 35, 36 coupled between the side faces and a planar horizontally oriented central extent 37. For positioning of the floor housing between the smoking and the nonsmoking section below the ceiling housing, the elongated floor housing has a plurality of rollers 30 mounted to the bottom face thereof.

An elongated outlet slot 58 is formed along a length of the central extent of the top face of the floor housing. Formed along a length of the bottom face of the floor housing is an elongated inlet slot 34. For suctioning air from the inlet slot and excreting the same from the outlet slot of the floor housing, an vacuum fan 42 is mounted within the interior space thereof. In the preferred embodiment, the floor housing is equipped with filters 39, 40 similar to those of the ceiling housing. It should be noted that the inlet slot of the present embodiment may readily be situated on one of the side faces of the floor housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A smoke diverter system comprising, in combination:

an elongated first housing for mounting on a ceiling and having a longitudinal direction extending parallel to the longest dimension of the housing, the elongated housing having a horizontally oriented planar top wall, a pair of vertically oriented side walls integrally coupled to opposed edges of the top wall and depending downwardly therefrom and a bottom wall thereby defining an interior space, the bottom wall having a pair of beveled side wall portions coupled between the side walls and a planar horizontally oriented central wall portion between the side wall portions of the bottom wall, whereby the elongated first housing is adapted for being mounted to a ceiling of a room at a location between a smoking and a nonsmoking designated areas of a room;

an elongated outlet slot formed in the central wall portion of the bottom wall of the first housing and having a length extending in the longitudinal direction of the first housing;

an elongated inlet slot formed in one of the side walls of the first housing adjacent to the top wall thereof, the inlet slot having a length extending in the longitudinal direction of the first housing;

an elongated substantially planar intake filter having elongated edges, one of the elongated edges being mounted on the top wall and the other of the elongated edges being mounted to the side wall of the first housing having the inlet slot formed therein, the intake filter being for filtering air entering the first housing through the inlet slot in the side wall;

an elongated substantially planar outlet filter having elongated edges, each of the elongated edges being mounted on one of the side walls of the first housing such that the outlet filter extends between the side walls in a location adjacent to the bottom wall of the first housing, the outlet filter being for filtering air exiting the first housing thought the outlet slot;

a vacuum fan mounted in the interior space of the first housing having a propeller with an axis of rotation oriented perpendicular to the substantially planar inlet filter for pulling air into the first housing through the inlet slot and pushing air out of the first housing through the outlet slot;

an elongated second housing for resting on a floor and having a longitudinal direction extending parallel to the longest dimension of the housing having a horizontally oriented planar bottom wall, a pair of vertically oriented side walls integrally coupled to opposed edges of the bottom wall and extending upwardly therefrom and a top wall thereby defining an interior space, the top wall having a pair of beveled side wall portions coupled between the side walls and a planar horizontally oriented central wall portion between the side wall portions of the bottom wall, wherein the elongated second housing has a plurality of rollers mounted to the bottom wall thereof for supporting the second housing on a floor at a location between smoking and a nonsmoking designated areas of a room;

an elongated outlet slot formed in the central wall portion of the top wall of the second housing and having a length extending in the longitudinal direction of the second housing;

an elongated inlet slot formed in the bottom wall of the second housing and having a length extending in the longitudinal direction of the second housing; and a vacuum fan mounted in the interior space of the second housing for pulling air into the second housing through the inlet and pushing air out of the second housing though the outlet slot thereof.

2. A smoke system comprising:

elongated housing mounted on a ceiling of a room of a structure, the housing having a longitudinal direction extending parallel to the longest dimension of the housing, the elongated housing extending from one side wall of the room to another side wall of the room, the housing being positioned between a smoking portion of the room designated for occupancy by smoking persons and a non-smoking portion of the room designated for occupancy by persons not smoking;

an elongated outlet slot formed in a bottom wall of the housing, the outlet slot having a length extending in the longitudinal direction of the housing;

an elongated inlet slot formed in the housing and having a length extending in the longitudinal direction of the housing;

at least one intake filter mounted in an interior of the housing between the inlet slot and the outlet slot of the housing such that air passing through the inlet and outlet slots must pass through the intake filter; and a vacuum fan mounted in the interior space of the housing for pulling air into the housing through the inlet slot and pushing air out of the housing through the outlet slot to produce a screen of air extending from one side wall of the room to the other side wall of the room between the smoking and non-smoking portions of the room.

3. A smoke diverter system as set forth in claim 2 wherein the bottom wall has a pair of beveled side wall portions and a central wall portion with the outlet slot being formed in the central wall portion, whereby the side wall portions direct air through the outlet slot.

4. A smoke diverter system as set forth in claim 2 additionally comprising a pair of filters, one of the pair of filters being located in an air path through the housing between the inlet slot and the fan such that air entering the housing through the inlet slot must pass through the one filter and the other one of the pair of filters being located in the air path through the housing between the outlet slot and the fan such that air exiting the housing through the outlet slot must pass through the other filter.

5. A smoke diverter system as set forth in claim 2 wherein the housing forms a first housing, and additionally comprising an elongated second housing resting on the floor of the room and having a longitudinal direction extending parallel to the longest dimension of the second housing, the longitudinal direction of the second housing being parallel to the longitudinal direction of the first housing, the second housing being positioned below the first housing mounted on the ceiling of the room, the second housing comprising:

a horizontally oriented planar bottom wall, a pair of vertically oriented side walls integrally coupled to opposed edges of the bottom wall and extending upwardly therefrom and a top wall thereby defining an interior space, the top wall having a pair of beveled side wall portions coupled between the side walls and a planar horizontally oriented central wall portion between the side wall portions of the bottom wall, wherein the elongated second housing has a plurality of rollers mounted to the bottom wall thereof for supporting the second housing on a floor at a location between smoking and a nonsmoking designated areas of a room;

an elongated outlet slot formed in the central wall portion of the top wall of the second housing and having a length extending in the longitudinal direction of the second housing;

an elongated inlet slot formed in the bottom wall of the second housing and having a length extending in the longitudinal direction of the second housing; and a vacuum fan mounted in the interior space of the second housing for pulling air into the second housing through the inlet slot and pushing air out of the second housing through the outlet slot such that a screen of filtered air is directed upwardly from the outlet slot of the second housing to meet downwardly directed air exiting the first housing mounted on the ceiling of the room.

6. A smoke diverter system comprising:

an elongated first housing for mounting on a ceiling and having a longitudinal direction extending parallel to the longest dimension of the housing, the elongated housing having a horizontally oriented planar top wall, a pair of vertically oriented side walls integrally coupled to opposed edges of the top wall and depending downwardly therefrom and a bottom wall thereby defining an interior space, the bottom wall having a pair of beveled side wall portions coupled between the side walls and a planar horizontally oriented central wall portion between the side wall portions of the bottom wall, whereby the elongated first housing is adapted for being mounted to a ceiling of said room at a location between a smoking and a nonsmoking designated areas of a room;

an elongated outlet slot formed in the central wall portion of the bottom wall of the first housing and having a length extending in the longitudinal direction of the first housing;

an elongated inlet slot formed in one of the side walls of the first housing adjacent to the top wall thereof, the inlet slot having a length extending in the longitudinal direction of the first housing;

an elongated substantially planar intake filter having elongated edges, one of the elongated edges being mounted on the top wall and the other of the elongated edges being mounted to the side wall of the first housing having the inlet slot formed therein, the intake filter being for filtering air entering the first housing through the inlet slot in the side wall;

an elongated substantially planar outlet filter having elongated edges, each of the elongated edges being mounted on one of the side walls of the first housing such that the outlet filter extends between the side walls in a location adjacent to the bottom wall of the first housing, the outlet filter being for filtering air exiting the first housing through the outlet slot;

a vacuum fan mounted in the interior space of the first housing having a propeller with an axis or rotation oriented perpendicular to the substantially planar inlet filter for pulling air into the first housing through the inlet slot and pushing air out of the first housing through the outlet slot such that when the first housing is mounted on said ceiling, a screen of filtered air is directed downwardly from the outlet slot of the first housing.

7. The smoke diverter system of claim 6 additionally comprising:

an elongated second housing for resting on a floor and having a longitudinal direction extending parallel to the longest dimension of the housing having a horizontally oriented planar bottom wall, a pair of vertically oriented side walls integrally coupled to opposed edges of the bottom wall and extending upwardly therefrom and a top wall thereby defining an interior space, the top wall having a pair of beveled side wall portions coupled between the side walls and a planar horizontally oriented central wall portion between the side wall portions of the bottom wall, wherein the elongated second housing has a plurality of rollers mounted to the bottom wall thereof for supporting the second housing on a floor at a location between smoking and a nonsmoking designated areas of a room;

an elongated outlet slot formed in the central wall portion of the top wall of the second housing and having a length extending in the longitudinal direction of the second housing;

an elongated inlet slot formed in the bottom wall of the second housing and having a length extending in the longitudinal direction of the second housing; and a vacuum fan mounted in the interior space of the second housing for pulling air into the second housing through the inlet slot and pushing air out of the second housing through the outlet slot such that when the second housing is rested on a floor surface, a screen of filtered air is directed upwardly from the outlet slot of the second housing to meet downwardly directed air exciting the first housing mounted on said ceiling above the floor.

* * * * *